US005607344A

United States Patent [19]

Endres

[11] Patent Number: 5,607,344

[45] Date of Patent: Mar. 4, 1997

[54] APPARATUS FOR GRIPPING AND HOLDING GLASS DURING A GLASS GRINDING PROCESS

[76] Inventor: Nicholas Endres, 2500 Meyerhill Dr., Cincinnati, Ohio 45211

[21] Appl. No.: 438,450

[22] Filed: May 10, 1995

[51] Int. Cl.[6] ..... B24B 41/06

[52] U.S. Cl. ..... 451/386; 451/370; 269/254 CS; 81/302; 81/417; 81/421

[58] Field of Search ..... 457/365, 367, 457/370, 386, 44; 269/254 CS, 238, 274; 81/302, 417, 421, 422, 423

[56] References Cited

U.S. PATENT DOCUMENTS

| | | | |
|---|---|---|---|
| 1,051,544 | 1/1913 | Bohm | 269/254 CS |
| 1,445,908 | 2/1923 | Perkins | 81/421 |
| 2,815,777 | 12/1957 | Iraids | 81/424 |
| 2,823,565 | 11/1956 | Bohland | 81/423 |
| 2,827,815 | 3/1958 | Smoyak | 81/417 |
| 2,861,833 | 11/1958 | Nierhaus | 81/302 |
| 3,261,244 | 7/1966 | Smoyak et al. | 81/417 |
| 3,263,535 | 8/1966 | Zurcher | 81/302 |
| 4,461,193 | 7/1984 | Gruber et al. | 81/420 |
| 4,961,291 | 10/1990 | Lagassee | 451/386 |
| 5,065,650 | 11/1991 | Anderson et al. | 81/486 |
| 5,207,030 | 5/1993 | Herrmann | 51/217 R |

*Primary Examiner*—Willis Little
*Assistant Examiner*—Eileen P. Morgan
*Attorney, Agent, or Firm*—Wood, Herron & Evans, P.L.L.

[57] ABSTRACT

An apparatus for gripping and holding glass during a glass grinding process. The glass gripping and holding apparatus includes an elongated top shank and an elongated bottom shank pivotally connected, with the top shank being inclined toward the bottom shank. Both shanks each have a respective glass-gripping end portion that oppose one another in generally parallel disposition when gripping a piece of glass. A spring operatively connects the shanks toward each other, biasing the glass-gripping end portions of the shanks toward each other. A generally circular boss is located on the bottom shank to facilitate mobility of the apparatus across a table surface of a glass grinder.

19 Claims, 1 Drawing Sheet

APPARATUS FOR GRIPPING AND HOLDING GLASS DURING A GLASS GRINDING PROCESS

BACKGROUND OF THE INVENTION

This invention generally relates to a gripping apparatus and more particularly, to an improved glass gripping apparatus capable of securely holding small pieces of glass during a glass grinding process. The apparatus permits a user to safely and efficiently grind glass.

Various glass grippers are known in the art. For example, U.S. Pat. No. 5,207,030 discloses a device for holding small glass pieces for grinding comprised of two curved, crossed arms or shanks pivotally connected. This device may be placed flatly on a surface of a grinding table during the grinding process. The device is similar to pliers as the user must constantly squeeze the arms together to hold a piece of glass therebetween. Thus, the user cannot release his grip of the arms during the grinding process without the glass being released from the device.

A similar glass gripping apparatus is disclosed in U.S. Pat. No. 4,961,291. This apparatus also closely resembles and functions like a pair of pliers as the apparatus has two curved, crossed arms pivotally connected. Again, the user must constantly squeeze the arms together to hold a piece of glass therebetween, and there is nothing to stabilize the device when placed on a grinding table.

It will be appreciated that it is desirable for a glass gripping apparatus to be able to secure the glass between its arms without the user having to constantly squeeze the arms together. Without the capability of a glass gripping apparatus being able to alone secure glass between its arms, the user must always concentrate on squeezing the arms of the apparatus together so that the glass does not slip out from between the arms and injure the user. When the user must concentrate on applying pressure to grip the glass, his dexterity and flexibility are limited and this limits his ability to freely move the glass with respect to the grinding wheel.

It is also important for a glass gripping apparatus to be able to support glass securely in a generally parallel disposition to the surface of a grinding table during the grinding process. Furthermore, it is desirable to be able to freely manipulate the device with the glass held therein since edges of the glass to be ground are frequently wavy or serpentine and the glass must be manipulated in many directions against the grinding wheel.

Although there are other devices pertaining to various hand held tools such as those disclosed in U.S. Pat. Nos. 5,065,650; 4,461,193; 2,815,777 and 3,263,535, none of these tools are particularly useful for holding glass. The tools disclosed in all of these patents have curved arms or shanks with a spring between the arms biasing the arms towards each other. The arms of the devices in the '650, '193, and '777 patents are both curved and crossed. Due to the curved arms of all of these tools as well as the crossing of the arms in the devices disclosed in the '650, '193 and '777 patents, a user cannot place the tools on a flat surface such as a grinding table of a grinder. Furthermore, the arms of these devices are incapable of safely and securely holding a piece of glass between them. For example, the device disclosed in U.S. Pat. No. 2,815,777 has clamping jaws with teeth connected to the respective ends of the curved arms such that a piece of glass would be scratched or shattered if held by these jaws.

It will be appreciated that while certain of the noted devices have a biasing spring located between the respective arms of the tools so that an object can be held without the user having to continually squeeze the arms together, the tools do not readily accommodate the gripping of glass or the presentation of glass to a grinding wheel. Furthermore, the known tools do not permit a user to place the tools flatly against a grinding table of a grinder during the grinding process. Thus, the glass cannot be ground at a preferable parallel disposition with the grinding table and at a preferable perpendicular angle against the grinding wheel.

Accordingly, the primary objective of the present invention has been to provide a glass-gripping apparatus capable of securely holding a small piece of glass without the user having to continually squeeze the arms or shanks of the apparatus together to securely hold a piece of glass therebetween.

Another objective of the present invention has been to provide a glass gripping apparatus capable of being placed securely but movably upon a surface of a glass grinding table of a grinder having a grinding wheel protruding therefrom, so that the glass can be ground at a preferable parallel disposition with the grinding table and at a preferable perpendicular angle against the grinding wheel, and can be easily moved with respect to the table and the grinding wheel to accommodate the grinding process.

It has been a further objective of the present invention to provide a glass gripping apparatus capable of freely sliding across a table surface of a glass grinder so that a piece of glass held thereby can easily be manipulated for grinding along the entire length of an edge thereof.

SUMMARY OF THE INVENTION

To these ends, a preferred embodiment of the present invention includes apparatus for holding glass during a glass grinding process. The apparatus has an elongated top shank and an elongated bottom shank pivotally connected together, but not crossed. Both shanks each have a respective glass gripping end portion that oppose one another in generally parallel disposition when gripping a piece of glass therebetween. Thus, when the device is placed on a generally flat surface such as a grinding table, the gripping end portions and the glass held therebetween are generally parallel to the table surface of the grinder.

The top shank has a hand gripping portion, an intermediate portion being inclined toward the bottom shank, as well as the end portion. The bottom shank has a generally flat bottom surface so that it can be placed succinctly upon a table surface of a glass grinder. The shanks have a spring operatively connected between them, biasing the glass-gripping end portions of the shanks toward each other.

The shanks are manually pivotable toward each other to cause the end portions of each shank to move away from each other for releasing glass and for receiving glass therebetween for gripping. The glass-gripping end portions of both shanks have an inner surface opposing each other. These inner surfaces are optimally covered with a rubber material to improve the grip exerted on the glass held between the end portions and at the same time, to prevent the glass from being scratched or shattered. The spring alone biases the end portions toward each other with sufficient force to hold a piece of glass during grinding of an edge thereof. This eliminates the user having to continually squeeze the shanks together to hold a piece of glass therebetween. Since no "squeeze" is required to hold the glass, the full flexibility and dexterity of the user's hand are available to guide the glass accurately against the grinding wheel.

The apparatus may further have a boss located on the bottom shank near the glass gripping end portion of that shank. The boss is generally circular with a flat bottom surface that is in general parallel orientation with the bottom flat surface of the bottom shank. This boss assures the glass is held parallel to the grinding table, and perpendicular to the wheel for accuracy. As well, it eliminates catching of the gripper in the grooves of the table.

The glass-gripping apparatus with the circular boss is suitable for gripping and holding glass during a grinding operation on a grinder having a table surface and a grinder wheel extending outwardly from said table surface. Such tables are typically grooved so that an edge or corner of a gripper might lodge into a groove thus restricting free movement of the glass relative to the wheel. The gripper boss is slightly spaced from the bottom flat surface of the bottom shank such that the bottom surface of the boss generally supports the apparatus as it rests upon the table surface of the grinder. Thus, the flat surface of the bottom shank is in a slightly elevated disposition from the table surface. This circular boss permits a user to freely slide the apparatus across a grinding table of a glass grinder during the grinding process so to easily manipulate the glass with respect to the grinding wheel, and without any sharp edge or corner to lodge in a table groove. Therefore, a user can completely and easily grind a piece of glass at all necessary points along the edge of the glass since the apparatus can readily be moved to various positions on the grinding table.

BRIEF DESCRIPTION OF THE DRAWINGS

These and other modifications and advantages will become even more readily apparent from the following detailed description of a preferred embodiment of the invention, and from the drawings in which.

DETAILED DESCRIPTION OF THE INVENTION

Figure 1:
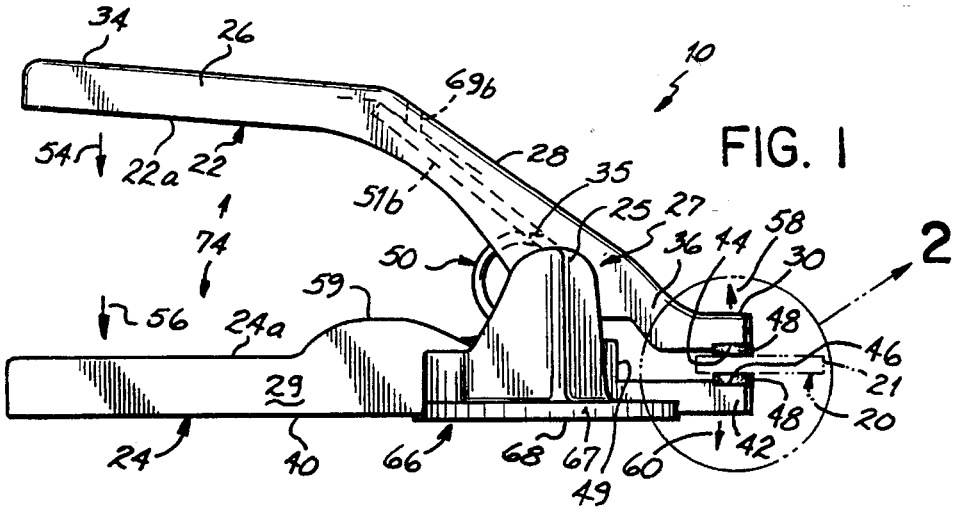
FIG. 1 is a side elevational view of a preferred embodiment of a glass-gripping apparatus in accordance with this invention.

With reference to FIG. 1, a glass gripping apparatus 10, preferably made of 30% glass-filled polypropylene, or any other suitable material, is shown having an elongated top shank 22 and an elongated bottom shank 24 pivotally connected at 25 to each other but not crossed. Apparatus 10 is shown gripping a piece of glass 20 (phantom lines) between top shank 22 and bottom shank 24. Typically, apparatus 10 is designed to hold glass 20 about ⅛ inch thick. However apparatus 10 can be designed to hold glass 20 of various thicknesses.

Top shank 22 has a hand gripping portion 26, an intermediate portion 28 being inclined toward bottom shank 24, and a glass-gripping end portion 30. Hand gripping portion 26 may have grooves 32 on top surface 34 of top shank 22 to improve a user's grip of apparatus 10. Intermediate portion 28 of top shank 22, is inclined toward bottom shank 24, and is pivotally connected on pivot axis 25 to projections or flanges 27 extending upwardly from bottom shank 24. As will be appreciated from a review of FIG. 5, to be described, flanges 25 serve as finger support members during use. Pivot axis 25 is generally located at end 36 of intermediate portion 28 nearer to bottom shank 24. Glass gripping end portion 30 of top shank 22 extends from intermediate portion 28.

Bottom shank 24 has a flat bottom surface 40 with a respective end portion 42 opposing end portion 30 of top shank 22. Piece of glass 20 may be inserted between respective inner surfaces 44, 46 of end portions 30, 42. End portions 30, 42 oppose each other in generally parallel disposition when gripping glass 20 therebetween.

Figure 2:
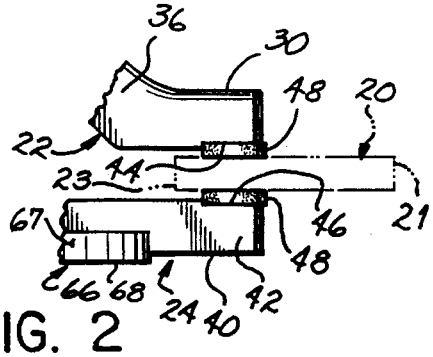
FIG. 2 is an enlarged view of the encircled area 2 of the present invention of FIG. 1.

As shown in FIG. 2, inner surfaces 44, 46 of end portions 30, 42 are advantageously covered with a rubber material 48 to improve the grip of glass 20 between end portions 30, 42. For glass 20 to be sufficiently gripped by rubber material 48, rubber material 48 cannot be too hard or too soft. Optimally, rubber material is of 70 durometer. Rubber material 48 protects glass 20 from being scratched and/or possibly broken as rubber material 48 provides a non-marring and flexible cushion between end portions 30, 42 of shanks 22, 24. Rubber material 48 also accommodates vagaries and unevenness in the thickness of glass 20. Thus, rubber material 48 primarily improves grip on the glass 20 and simultaneously provides a cushion for glass 20. Other types of gripping, non-marring material besides rubber may be used.

Figure 6:
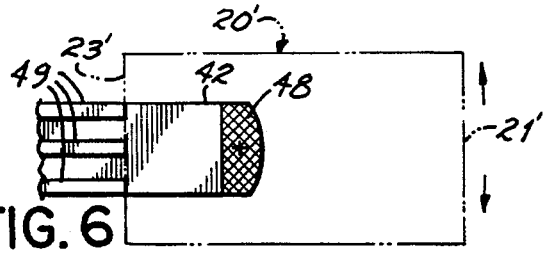
FIG. 6 is a partial plan view of the bottom shank of the apparatus of FIG. 1.

Another feature which improves the gripping ability of apparatus 10, especially when gripping large pieces of glass 20', is the presence of stops 49 (FIGS. 1, 6) located on end portion 42 of bottom shank 24 as shown in FIGS. 1 and 6. Small pieces of glass 20 (FIGS. 1, 2) can be sufficiently gripped by end portions 30, 42 having rubber material 48 thereon. Large pieces of glass 20' however, may rotate or pivot from side to side in the direction of the arrows (FIG. 6) during the grinding process due to pressure exerted thereon from a glass grinder 64 (see FIG. 5). To prevent such rotation and pivoting, glass 20' is advantageously, placed between end portions 30, 42 such that a back edge 23' of glass 20' rests against stops 49. Pressure from grinder 64 (see FIG. 5) forces back edge 23' of glass 20' against stops 49, and stops 49 in turn prevent glass 20' from pivoting or rotating while held in apparatus 10. Glass 20' will safely remain between end portions 30, 42 during the grinding process, and will not slide out of apparatus 10 unless glass 20' both pivots and moves in shear relative to apparatus 10. That is, when the glass engages the stops, it cannot merely pivot about the grip point provided by the rubber material (when stressed). Instead, it must both pivot and move in shear. This takes a great deal more relative force to overcome than a mere pivoting action, when the glass is not against the stops, and thus provides a secure hold for even large pieces of glass which may present longer effective lever arms to the wheel so the glass could be pivoted if it were not for the stops. Therefore, not only is glass 20' secured by rubber material 48 between end portions 30, 42, but glass 20' is further secured by the cooperation of rubber material 48 and stops 49 holding the glass against rotation.

Figure 3:
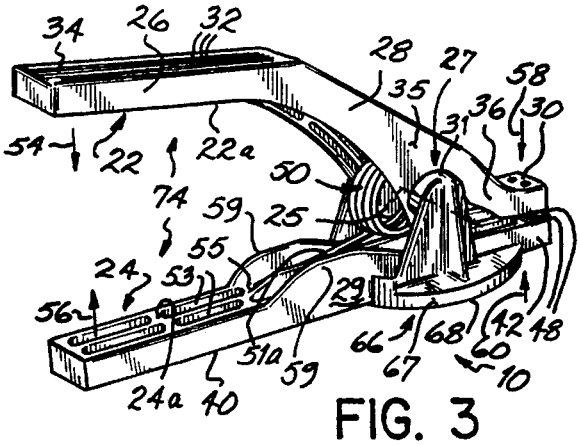
FIG. 3 is a perspective view of the apparatus of FIG. 1.

As shown in FIG. 3, a spring 50 with extending legs **51*a*, 51*b*** (not shown) is operatively connected between top shank 22 and bottom shank 24 biasing them apart and thus biasing end portions 30, 42 toward each other. Leg 51*a* exerts a downward force against the posterior inner surface 24*a* of bottom shank 24, while leg 51*b* exerts an upward force against the posterior inner surface 22*a* of top shank 22 thus forcing hand-gripping portion 26 of top shank 22 in an opposite direction from bottom shank 24. Legs 51*a*, 51*b* lie in troughs 53 on inner surfaces 22*a*, 24*a* of shanks 22, 24. End abutments 55 are located in troughs 53 on inner surfaces 22*a*, 24*a* of shanks 22, 24. End abutments 55 serve to prevent legs 51*a*, 51*b* of spring 50 from sliding therepast, thus securing spring between shanks 22, 24 and retaining it from slipping rearwardly.

Figure 7:
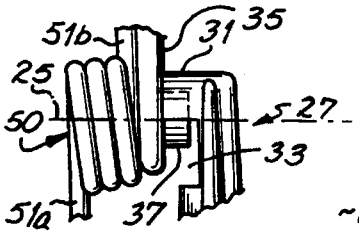
FIG. 7 is a partial rear view of the right side of the hinged area of the apparatus of FIGS. 1 and 3.

As shown in FIG. 3 and FIG. 7, spring 50 facilitates the establishment of pivotal connection along axis 25 between top shank 22 and bottom shank 24. To pivotally connect top shank 22 and bottom shank 24, flanges 27 extend upwardly in a general perpendicular disposition from sides 29 of bottom shank 24 toward intermediate portion 28 of top shank 22. Each flange 27 has an inwardly directed hood 31 extending around most of the perimeter of flange 27 to define a cavity which serves as a trunnion. Each hood 31 has a rearwardly facing opening 33 adjacent to spring 50 such that hood 31 does not extend in a continuous manner around the perimeter of flange 27. Top shank 22 has a generally circular pivot pin 37 extending from each side 35 of intermediate portion 28. On assembly, when the top shank 22 is moved forwardly each pivot pin 37 is inserted through respective opening 33 into the cavity and is thus pivoted therein on axis 25. Spring 50 is pushed between top shank 22 and bottom shank 24 toward pivotal axis 25 so that its legs 51*a*, 51*b* engage a respective shank as described above. By using this particular pivotal connection as at axis 25, a through pin is not necessary to establish pivotal connection 25 which in turn, saves assembly time and money.

Bottom shank 24 has hole 69*a* (FIG. 4) located on flat, bottom surface 68, while top shank 22 has hole 69*b* (FIG. 1) located on top surface 34 of intermediate portion 28. Holes 69*a*, 69*b* enable the apparatus to be disassembled as the legs 51*a*, 51*b* of spring 50 can be contacted through holes 69*a*, 69*b* and pushed upward and outward from between shanks 22, 24. When spring 50 is removed from between shanks 22, 24, shanks 22, 24 can easily be disconnected from each other at pivotal axis 25 by withdrawing pivot pins 37 of top shank 22 through openings 33 of hoods 31.

Apparatus 10 alone can securely grip glass 20 between end portions 30, 42 with sufficient force to hold glass 20 during the grinding process because of spring 50 independently biasing end portions 30, 42 of shanks 22, 24 toward each other. To release glass 20 top shank 22 and bottom shank 24 are manually pivoted toward each other in direction of arrows 54, 56 to cause end portions 30, 42 to move away from each other in direction of arrows 58, 60 freeing glass 20 from between respective end portions 30, 42. It will be appreciated that the material and structure of the shanks are selected to render these sufficiently stiff to accept a spring loading necessary for glass gripping without distortion of the shanks.

Figure 4:
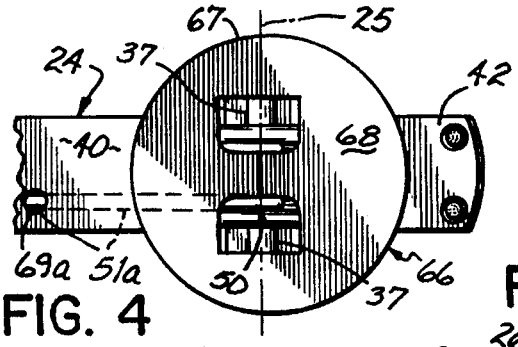
FIG. 4 is a partial bottom elevational view of the apparatus of FIG. 1.

During the grinding process, it is advantageous that apparatus 10 be freely mobile across a table surface 62 of a glass grinder 64 so that glass 20 can be effectively ground as desired. (See FIG. 5). Table surface 62 typically has grooves 63 separated by lands 65 lying in a flat plane. (See FIG. 5). To facilitate mobility across grooved table surface 62, flat bottom surface 40 of bottom shank 24 has a boss 66 in general parallel orientation with bottom surface 40 of bottom shank 24 as shown in FIG. 4. Boss 66 is generally circular and is defined by a sharp, circular edge 67. Circular boss 66 has no corners and thus eliminates the possibility of a corner thereof getting accidentally caught on grinder 64 or in grooves 63 of table surface 62 as apparatus 10 is being slid or moved across grinder's 64 table surface 62. (See FIG. 5). Boss 66 has a flat, bottom surface 68 which facilitates the ease of movement of apparatus 10 on grinder's table surface 62. (See FIG. 5).

Figure 5:
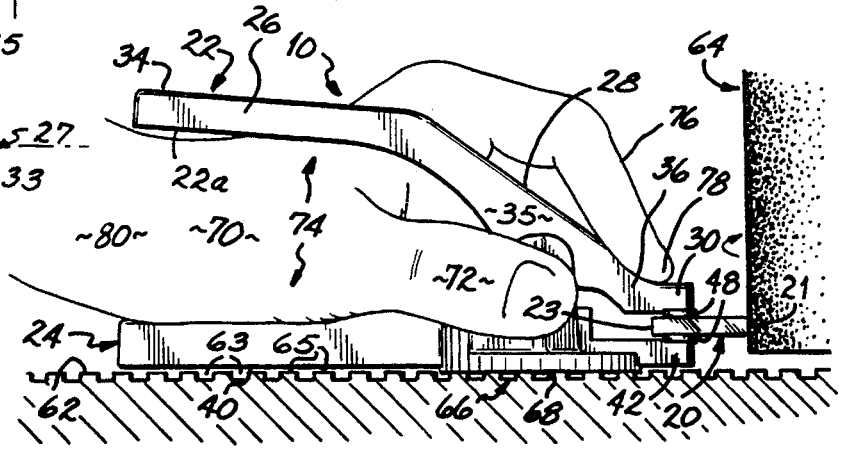
FIG. 5 is a side elevational view of the apparatus of FIG. 1 in use on a glass grinder.

As shown in FIG. 5, boss 66 is spaced slightly from bottom flat surface 40 of bottom shank 24 such that bottom surface 68 of boss 66 generally supports apparatus 10 as it rests upon grooved table surface 62 of glass grinder 64. Thus, flat bottom surface 40 of bottom shank 24 is in a slightly elevated disposition from table surface 62 of grinder 64 which in turn, reduces the amount of friction between apparatus 10 and table surface 62 thereby improving mobility of apparatus 10 across table surface 62. Behind each flange 27 and behind boss 66, bottom shank 24 increases in thickness to form a generally semicircular projection 59. Projection 59 facilitates in strengthening bottom shank 24 and elevating bottom shank 24 from table surface 62 thereby preventing bottom shank 24 from bending downward toward table surface 62 and improving mobility of apparatus 10. The mobility of apparatus 10 and glass 20 held therein is often necessary because the edges 21 of glass 20 to be ground may be wavy and thus, glass 20 has to be manipulated in many directions against grinder 64 to completely grind all necessary edges 21 of glass 20.

Boss 66 also keeps dust or debris (not shown) from getting caught between bottom surface 40 of bottom shank 24 and table surface 62 of grinder 64, further facilitating mobility of glass-gripper 10. As glass 20 is being ground, debris produced from grinding falls onto the lands 65 or into the grooves 63 of table surface 62. As boss 66 is moved across table surface 62, sharp, circular edge 67 of boss 66 pushes the debris from lands 65 into grooves 63, thereby preventing the debris from inhibiting mobility of apparatus 10 during grinding and allowing it to remain flat on the table. Any debris that is protruding upwardly from grooves 63 will likewise be pushed downward into grooves 63 below lands 65 as sharp, circular edge 67 of boss 66 passes over table surface 62.

As shown in FIG. 5, apparatus 10 permits a user's hand 70 to grip apparatus 10 in a manner similar to a pencil. A user may place a thumb 72 through the space 74 between top shank 22 and bottom shank 24. Thumb 72 may wrap around apparatus 10 and rest against apparatus 10 at various positions, such as where top shank 22 and bottom shank 24 are pivotally connected at 25. Forefinger 76 may respectively wrap around top shank 22 and rest on top surface 34 thereof with fingertip 78 positioned near glass gripping end portion 30. Spring 50 biases respective glass gripping end portions 30, 42 toward one another to grip glass 20 and frees the user's thumb 72, forefinger 76, and remaining fingers (not shown) to grip apparatus in numerous other ways as will be appreciated by those in the art. Thus, spring 50, which biases end portions 30, 42 toward one another, provides flexibility to the user and permits the user to freely use both his hand 70 (with fingers thereon) and his wrist 80 to move apparatus 10 in any desired manner during grinding. If the user had to squeeze shanks 22, 24 of apparatus 10 during grinding to hold glass 20 therein, the user would lose such flexibility.

Since grinding is a wet process as water (not shown) wets grinder 64, spring 50 further enables the user to keep hand 70 from getting wet and from getting debris from table surface 62 thereon as the user does not have to squeeze bottom shank 24 (adjacent to table surface 62 where the debris and water are located) together with top shank 22 to hold glass 20 therebetween. Chapping or chafing from the water or debris under the fingernails is thus eliminated.

Spring 50 also enables the user to grind glass 20 quickly and accurately since apparatus 10 grips glass 20 independently and with sufficient force such that glass 20 does not move between end portions 30, 42 during grinding. Glass 20 must be ground to the relevant edge of a paper template (not shown) glued onto the glass. Grinding speed is critical since too much exposure to the moisture of the system during grinding will moisten the glue and ruin the template or cause it to come loose, thus hindering accurate grinding of glass 20.

Based on the foregoing description, it will be appreciated that the glass gripping apparatus 10 of the present invention provides the ability to securely grip and hold a piece of glass 20 between the top shank 22 and bottom shank 24 without a user having to continually squeeze the shanks 22, 24 together. Moreover, the glass gripping apparatus 10 is able to support a piece of glass 20 therein securely in a parallel disposition to the table surface 62 of a glass grinder 64, and securely against the grinding wheel since the apparatus 10 can be placed flatly on the table surface 62 of the glass grinder 64. The grip on the glass 20 between the shanks 22, 24 is greatly facilitated by the presence of rubber material 48 on the inner surfaces 44, 46 of the glass gripping end portions 30, 42 and by stops 49 located on inner surface 44 of bottom shank 24. The use of rubber material 48 also accommodates vagaries and unevenness in glass thickness.

Furthermore, while the apparatus 10 can rest securely on the table surface 62 of the glass grinder 64, it is freely movable across the table 62 because of the presence of the generally circular boss 66 located on the bottom surface 40 of the bottom shank 24. Manipulation of the apparatus 10 and glass 20 held therein is important because the edges 21 of the glass 20 are often wavy and serpentine, and the glass 20 must be manipulated in many directions against the grinding wheel of the grinder 64. The circular boss advantageously has no square edges which could get caught on the grinder 64. Additionally, the boss 66 keeps dust and debris from getting caught under the apparatus 10, further facilitating mobility of the apparatus 10 across the table surface 62 of the grinder 64.

It will also be appreciated that the apparatus 10 can additionally be secured and manipulated on the table surface 62 of the grinder 64 by the user gripping the apparatus 10 like a pencil such that he places his forefinger 76 on the top surface 34 of the top shank 22 and applies pressure thereon. Also, the users's hand 70 remains free from the table surface 62 out of the water and away from the debris, thereby preserving the physical appearance of the user's hand 70. Furthermore, glass 20 can be ground accurately and quickly which is critical because of the possible loss of the template from contact with the water.

Also, it will be appreciated that the glass is introduced to the wheel at a position elevated from the plane of the table. Since the gripper holds the glass securely, it is possible for the user to force the glass into the wheel making an accurate edge but at the same time with a healthy cut which extends the useful lifetime of the wheel.

From the above disclosure of the general principles of the present invention and the detailed description of a preferred embodiment, those skilled in the art will readily comprehend the various modifications to which the present invention is susceptible without departing from the scope of the present invention. Therefore, Applicant desires to be limited only by the scope of the following claims and equivalents thereof.

What is claimed is:

1. An apparatus for gripping and holding glass during a glass grinding process on a grinder having a table with a flat surface lying in a generally flat plane and a grinder wheel extending outwardly from said table surface, said apparatus comprising:

a) an elongated top shank having a first glass gripping jaw on one end and a first handle on another end;

b) an elongated bottom shank having a second glass gripping jaw on one end and a second handle on another end;

c) said shanks being pivotally interconnected together on a pivot axis with said first and second jaws being on one side of said pivot and said first and second handles being on another side of said pivot such that when said first and second handles are squeezed toward each other, said first and second jaws move away from each other;

d) a spring operatively connected between said shanks biasing said first and second handles away from each other and said first and second jaws toward each other;

e) said spring biasing said jaws toward each other with sufficient force to hold a piece of glass therebetween during grinding of an edge thereof; and f) a stop disposed between said jaws and including a substantially vertical stop surface for engaging an edge of a piece of glass gripped between said jaws.

2. Apparatus as in claim 1 further including a flat support surface extending from said bottom shank under said pivot axis and for supporting said apparatus on a flat grinding table during grinding a piece of glass gripped between said jaws.

3. Apparatus as in claim 2 wherein said flat support surface is circular in peripheral shape.

4. Apparatus as in claim 3 wherein said flat support surface extends substantially parallel to said bottom shank and is disposed in a plane below said bottom shank.

5. Apparatus as in claim 2 wherein said flat support surface comprises a circular boss extending beneath said bottom shank under the pivot interconnection of said two shanks.

6. Apparatus as in claim 5 wherein said bottom shank extends substantially parallel to said flat support surface and is spaced above said grinder table flat surface when said apparatus grips and holds glass being ground on said grinder.

7. Apparatus as in claim 6 wherein said bottom shank has a substantially flat bottom surface disposed parallel to said flat support surface.

8. Apparatus as in claim 1 wherein said top shank comprises a first intermediate handle portion inclined upwardly from said pivot axis and a second handle portion extending from said first intermediate handle portion and substantially parallel to said second handle on said bottom shank.

9. Apparatus as in claim 1 wherein each of said jaws comprise glass gripping surfaces defined by glass gripping resilient pads.

10. Apparatus as in claim 1 wherein said first and second handles are spaced apart at a distance sufficient to accommodate a human thumb extending therebetween for manual gripping of said apparatus around the pivot interconnection of said shanks.

11. Apparatus as in claim 10 wherein said spring is a coil spring coiled about a spring axis proximate and parallel to said pivot axis.

12. Apparatus as in claim 11 wherein said coil spring has two opposite ends, each one disposed along a respective one of said top and bottom shanks.

13. Apparatus as in claim 11 wherein said coil spring, except for said ends, is disposed on said pivot axis such that it is also encompassed by the hand of a user when manually gripped by a user.

14. Apparatus as in claim 11 wherein said stop comprises a glass engaging abutment formed in said bottom shank and wherein said jaws and said stop engage said glass at two spaced apart positions and cooperate to restrain glass gripped in said apparatus from turning in said apparatus when being ground in said grinder.

15. Apparatus for gripping and holding glass during a glass grinding process on a grinder having a table with a flat surface lying in a generally flat plane and a grinder wheel extending outwardly from said table surface, said apparatus comprising:

a) an elongated top shank having a first glass gripping jaw having a first gripping surface on one end and a first handle on another end;

b) an elongated bottom shank having a second glass gripping jaw having a second gripping surface on one end and a second handle on another end;

c) said shanks being interconnected together at a pivot connection with said first and second jaws being on one side of said pivot connection and said first and second handles being on another side of said pivot connection such that when said first and second handles are squeezed toward each other, said first and second jaws move away from each other;

d) a spring operatively connected between said shanks biasing said first and second handles away from each other and said first and second jaws toward each other;

e) said spring biasing said jaws toward each other with sufficient force to hold a piece of glass therebetween during grinding of an edge thereof; and f) a flat support surface substantially parallel to said first and second gripping surfaces for supporting said apparatus on the surface of a grinding table, said flat support surface extending rearwardly from said second glass gripping jaw at least to a position below said pivot connection.

16. Apparatus as in claim 15 wherein said support surface is circular in peripheral shape.

17. Apparatus as in claim 15 further including a stop disposed proximate said jaws for engaging an edge of a piece of glass gripped between said jaws at a position remote from the contact of said jaws with said gripped piece of glass.

18. Apparatus as in claim 17 wherein said stop comprises a glass engaging abutment formed in said bottom shank and wherein said jaws and said stop engage said glass at two spaced apart positions and cooperate to restrain glass gripped in said apparatus from turning in said apparatus when being ground in said grinder.

19. Apparatus for gripping and holding glass during a glass grinding process on a grinder having a table with a flat surface lying in a generally flat plane and a grinder wheel extending outwardly from said table surface, said apparatus comprising:

a) an elongated top shank having a first glass gripping jaw on one end and a handle on another end;

b) an elongated bottom shank having a second glass gripping jaw and a bottom flat support surface extending rearwardly from said second gripping jaw on one end and a handle on another end;

c) said shanks being interconnected together at a pivot connection with said first and second jaws being on one side of said pivot connection and said handles being on another side of said pivot connection such that when said handles are squeezed toward each other, said first and second jaws move away from each other;

d) a spring operatively connected between said shanks biasing said handles away from each other and said first and second jaws toward each other;

e) said spring biasing said jaws toward each other with sufficient force to hold a piece of glass therebetween during grinding of an edge thereof;

f) said handles being spaced apart; and g) first and second finger support members disposed on opposite sides of said pivot connection and extending generally between said pivot connection and said bottom flat support surface.

* * * * *